United States Patent [19]

Ayers et al.

[11] 3,951,703

[45] Apr. 20, 1976

[54] BALLISTIC MODIFICATION OF COMPOSITE PROPELLANTS BY USE OF 2-FERROCENYLTETRAHYDROFURAN NOVEL LIQUID COMPOUND

[75] Inventors: Orval E. Ayers, Huntsville; Dennis C. Van Landuyt, Auburn, both of Ala.

[73] Assignee: The United States of America as represented by the Secretary of the Army, Washington, D.C.

[22] Filed: June 15, 1971

[21] Appl. No.: 155,671

[52] U.S. Cl. ..... 149/19.2; 149/19.9; 149/20; 149/113; 260/346.1 M

[51] Int. Cl.[2] ..... C06B 45/10

[58] Field of Search ..... 260/346.1 M, 439 CY; 149/19, 44, 21, 76, 113, 19.2, 19.9, 20

[56] References Cited

UNITED STATES PATENTS

| | | | |
|---|---|---|---|
| 3,410,883 | 11/1968 | Rosenberg | 260/439 CY |
| 3,447,981 | 6/1969 | Sayles | 149/19 |
| 3,535,174 | 10/1970 | Bornstein | 149/19 |
| 3,598,850 | 8/1971 | Dewey | 260/439 CY |
| 3,607,471 | 9/1971 | Osborn | 149/19 |

*Primary Examiner*—Edward A. Miller
*Attorney, Agent, or Firm*—Nathan Edelberg; Robert P. Gibson; James T. Deaton

[57] ABSTRACT

The compound 2-ferrocenyltetrahydrofuran in solid propellant compositions as a ballistic modifier. This ballistic modifier increases the burning rate and improves the performance of the particular solid propellant composition in which it is incorporated. The propellant compositions contain in addition to said ballistic modifier, a binder, an oxidizer and a metal fuel.

7 Claims, No Drawings

BALLISTIC MODIFICATION OF COMPOSITE PROPELLANTS BY USE OF 2-FERROCENYLTETRAHYDROFURAN NOVEL LIQUID COMPOUND

BACKGROUND OF THE INVENTION

Solid propellant compositions are utilized extensively in rocket propellants. Still, there is a great need in perfecting solid propellants to obtain faster burning rates and improve the performance of the solid propellant. An approach to increasing the burning rate of solid propellants is through the addition of organometallo compounds to solid propellant compositions.

Therefore, it is an object of this invention to provide the compound 2-ferrocenyltetrahydrofuran in various propellant compositions to provide various burning rate propellants that range from 0.5 in/sec to 3.5 in/sec.

Another object of this invention is to provide solid propellant compositions that have incorporated therein as a ballistic modifier the compound 2-ferrocenyltetrahydrofuran.

Still another object of this invention is to provide solid propellant compositions that have increased burning rates and improved performance.

SUMMARY OF THE INVENTION

In accordance with this invention, solid propellant compositions are disclosed that include a binder, a metal fuel, an oxidizer and a ballistic modifier such as 2-ferrocenyltetrahydrofuran. Any of the commonly used inorganic oxidizers perform satisfactorily in the propellant compositions according to this invention. Further, depending upon the particular binder employed, small amounts of curing agents and processing aids may be used to accomplish the mixing and curing processes desired.

DETAILED DESCRIPTION OF THE INVENTION

Synthesis of 2-ferrocenyltetrahydrofuran. 70 Grams of lithium aluminum hydride and 500 milliters of anhydrous tetrahydrofuran are added under a dry nitrogen atmosphere to a two liter round-bottom flask that is equipped with a mechanical stirrer, a reflux condenser, and an addition funnel. By means of the addition funnel, a saturated solution of $\beta$-ferrocenoylpropionic acid methyl ester (300 grams) dissolved in sufficient anhydrous tetrahydrofuran is added slowly to the stirring tetrahydrofuran/lithium aluminum hydride mixture.

When the addition of the ester solution is complete, the reaction mixture is refluxed for 1 hour and then deactivated by the slow addition of 200 milliters of ethyl acetate, 200 milliters of 40/60 acetone/water mixture, and diluted HCl in the order given.

The organic and aqueous layer are separated and the aqueous layer is discarded. The organic layer is washed with 200 milliters of water, separated, dried over anhydrous calcium chloride, and stripped of solvents. A quantitative yield of 2-ferrocenyltetrahydrofuran is recovered as a light red liquid that has a boiling temperature of 131°C at 1 mmHg.

Structural assignment for 2-ferrocenyltetrahydrofuran based on N.M.R. and I.R. spectral data gives a Nuclear Magnetic Resonance Spectral data of a triplet centered at 4.63 ppm $J \approx 8$ cps.

Basically, the propellant compositions according to this invention comprise a binder of about 10 to about 25 weight percent, a metal fuel of about 5 to about 20 weight percent, an oxidizer of about 50 to about 75 weight percent and 2-ferrocenyltetrahydrofuran of an amount of about 0.01 to about 20 weight percent and preferrably from 1 to 10 weight percent. Also, depending upon the particular binder employed, small amounts of conventional curing agents and conventional processing aids may be used as necessary to accomplish the desired mixing and curing of the propellant compositions.

Inorganic oxidizing salts which are useful in the solid propellant compositions of this invention are those oxygen containing salts which readily give up oxygen. These oxidizing salts include ammonium, alkali metal, and alkaline earth metal salts of nitric, perchloric, and chloric acids, and mixtures thereof. Representative of the oxidizing salts referred to are ammonium perchlorate, ammonium nitrate, sodium nitrate, potassium perchlorate, potassium chlorate, lithium perchlorate, lithium chlorate, calcium nitrate, calcium chlorate, barium perchlorate, strontium chlorate, and strontium perchlorate. Ammonium perchlorate is preferred since less smoke results from lower solids present in exhaust gases from a rocket motor wherein used. Lower smoke solids are required for military purposes of concealment. Also, ammonium perchlorate is preferred since it is available in large as well as small particle sizes.

Metal fuels useful in this invention include metal powders as additives in the propellant compositions according to the invention. These metal additives include in addition to the preferred metal powder aluminum, magnesium, titanium, zirconium, and boron. Alloys and mixtures of the aforesaid metals may also be employed.

The binders according to this invention may be selected from carboxy terminated polybutadiene, hydroxy terminated polybutadiene, polybutadiene acrylic acid, and other hydro carbon binders.

Examples of propellant compositions according to this invention:

EXAMPLE I

| | % by Weight |
|---|---|
| Carboxy terminated polybutadiene | 17.81 |
| Tris[1-(2-methyl)aziridinyl]phosphine oxide | .56 |
| ERLA* 0510 (curing agent) | .18 |
| Aluminum (H-10) | 10.00 |
| Ammonium Perchlorate (1.1 Micron) | 66.45 |
| 2-ferrocenyltetrahydrofuran | 5.00 |

*Trifunctional expoxide produced by Shell Chemical Corporation.

The burning rate for this composition was 3.45 in/sec at 2000 psia.

EXAMPLE II

| | % by Weight |
|---|---|
| Carboxy terminated polybutadiene | 14.8 |
| Ammonium perchlorate (2.9 micron) | 65.0 |
| Aluminum (H-10) | 10.0 |
| Lecithin | 0.2 |
| 2-ferrocenyltetrahydrofuran | 10.0 |

The burning rate for this composition was 2.4 in/sec at 1500 psia. A control composition similar to this one but containing no catalyst gave a burning rate of 0.38 in/sec at 1500 psia.

EXAMPLE III

| | % by Weight |
|---|---|
| Hydroxy terminated polybutadiene | 14.0 |
| Aluminum (H-10) | 14.0 |
| Ammonium Perchlorate (2.9 micron) | 51.7 |
| Ammonium Perchlorate (200 micron) | 17.3 |
| 2-ferrocenyltetrahydrofuran | 3.0 |
| lecithin (added) | 0.2 |

The burning rate of this composition was 1.76 in/sec at 2000 psia.

EXAMPLE IV

| | % by Weight |
|---|---|
| Carboxy terminated polybutadiene | 1.48 grams or~15% |
| Aluminum (H-10) | 1.40 grams or~14% |
| Ammonium Perchlorate (1.1 micron) | 4.48 grams or~45% |
| Ammonium Perchlorate (200 micron) | 2.41 grams or~24% |
| 2-ferrocenyltetrahydrofuran | .30 grams or~3% |

The burning rate for this composition was 2.6 in/sec at 1500 psia.

We claim:

1. A solid propellant composition comprising a binder present in an amount of about 10 to about 25 weight percent, an oxygen oxidizer present in an amount from about 50 to about 75 weight percent, a metal fuel present in an amount of about 5 to about 20 weight percent, and 2-ferrocenyltetrahydrofuran present in an amount from about 0.01 to about 20 weight percent.

2. The propellant composition of claim 1, wherein said binder is carboxy terminated polybutadiene, wherein said oxidizer is ammonium perchlorate, and wherein said metal fuel is aluminum.

3. The propellant composition of claim 1, wherein said binder is hydroxy terminated polybutadiene, wherein said oxidizer is ammonium perchlorate and wherein said metal fuel is aluminum.

4. The propellant composition of claim 1, wherein said binder is carboxy terminated polybutadiene present in an amount of about 17 to 18 weight percent, wherein said oxidizer is ammonium perchlorate in an amount of about 66 to 67 weight percent, wherein said 2-ferrocenyltetrahydrofuran is present in an amount of about 5 weight percent, and wherein said propellant composition further comprises a trifunctional epoxide in an amount of about 0.18 weight percent and tris[1-(2-methyl)-aziridinyl]phosphine oxide in an amount of about 0.56 weight percent.

5. The propellant composition of claim 1, wherein said binder is carboxy terminated polybutadiene present in an amount of about 14 to about 15 weight percent, wherein said oxidizer is ammonium perchlorate in an amount of about 65 weight percent, wherein said metal fuel is aluminum in an amount of about 10 weight percent, wherein said 2-ferrocenyltetrahydrofuran is present in an amount of about 10 weight percent, and wherein said propellant composition further comprises lecithin in an amount of about 0.2 weight percent.

6. The propellant composition of claim 1, wherein said binder is carboxy terminated polybutadiene present in an amount of about 14 to about 15 weight percent, wherein said oxidizer is ammonium perchlorate and said ammonium perchlorate being present in an amount of 44 to 45 weight percent of 1.1 micron ammonium perchlorate and present in an amount of about 24 to 25 weight percent of 200 micron ammonium perchlorate, wherein said metal fuel is aluminum present in an amount of about 13 to 14 weight percent, and wherein said 2-ferrocenyltetrahydrofuran is present in an amount of about 3 weight percent.

7. The propellant composition of claim 1, wherein said binder is hydroxy terminated polybutadiene present in an amount of about 14 weight percent, wherein said oxidizer is ammonium perchlorate and said ammonium perchlorate is present in an amount of about 51 to 52 weight percent of 2.9 micron ammonium perchlorate and about 17 to about 18 weight percent of 200 micron ammonium perchlorate, wherein said metal fuel is aluminum present in an amount of about 14 weight percent, wherein said 2-ferrocenyltetrahydrofuran is present in an amount of about 3 weight percent, and wherein said propellant composition further comprises the ingredient lecithin added in an amount of about 0.2 weight percent of the other propellant ingredients.

* * * * *